US007350650B2

(12) United States Patent
Wilson

(10) Patent No.: US 7,350,650 B2
(45) Date of Patent: Apr. 1, 2008

(54) CRANE BEARING ASSEMBLY

(75) Inventor: George Lawrence Wilson, Houston, TX (US)

(73) Assignee: Seatrax, Inc., Houston, TX (US)

( * ) Notice: Subject to any disclaimer, the term of this patent is extended or adjusted under 35 U.S.C. 154(b) by 189 days.

(21) Appl. No.: 11/192,456

(22) Filed: Jul. 28, 2005

(65) Prior Publication Data

US 2006/0021958 A1 Feb. 2, 2006

Related U.S. Application Data

(60) Provisional application No. 60/591,703, filed on Jul. 28, 2004.

(51) Int. Cl.
*B66C 23/84* (2006.01)

(52) U.S. Cl. ..... 212/253; 384/591

(58) Field of Classification Search ..... 212/253; 384/591, 592

See application file for complete search history.

(56) References Cited

U.S. PATENT DOCUMENTS 226,996 A * 4/1880 Greenleaf ..... 384/591
957,343 A * 5/1910 Jensen ..... 212/232
1,582,274 A * 4/1926 Kaltenbach ..... 212/247
2,702,129 A * 2/1955 Liebherr ..... 212/224
3,391,810 A * 7/1968 Le Tourneau ..... 414/687
4,184,600 A 1/1980 Goss et al.
5,328,040 A 7/1994 Morrow
6,009,643 A * 1/2000 Maeba et al. ..... 37/443

FOREIGN PATENT DOCUMENTS

WO 97/46762 * 12/1997

OTHER PUBLICATIONS

Marathon LaTourneau Crane.

* cited by examiner

*Primary Examiner*—Thomas J. Brahan
(74) *Attorney, Agent, or Firm*—Keeling Patents and Trademarks; Kenneth A. Keeling; Kenneth P. Beyers

(57) ABSTRACT

An upper bearing assembly for a pedestal crane comprises a partially dome-shaped kingpost head operably engaged by a bearing having a concave bearing face shaped to conform to a segment of said kingpost head, the bearing enclosed within a bearing retainer, the bearing retainer attached to the crane upper works.

8 Claims, 4 Drawing Sheets

CRANE BEARING ASSEMBLY

CROSS-REFERENCE TO RELATED APPLICATIONS

This application claims the benefit of U.S. Provisional Patent Application No. 60/591,703 entitled, "Crane Bearing Assembly," filed on Jul. 28, 2004, in the United States Patent and Trademark Office.

STATEMENT REGARDING FEDERALLY SPONSORED RESEARCH OR DEVELOPMENT

Not Applicable.

BACKGROUND OF THE INVENTION

1. Field of Invention

The field of this invention is pedestal cranes, and particularly to a bearing assembly between the upper works of a pedestal crane assembly and the pedestal.

2. Description of the Related Art

Pedestal cranes include a revolving upper works mounted on a central pedestal support column or kingpost. The upper works typically comprise a swing column surrounding the kingpost, a turntable, the crane gantry, the operator cab and associated equipment. To prevent excessive wear between the upper works of the crane assembly and the kingpost as the upper works rotates about the pedestal of the crane, various bearing assemblies are employed. Commonly, a lower radial bearing assembly and an upper bearing system are utilized in a pedestal crane, with the upper bearing assembly including a thrust bearing for vertical loads and a radial bearing for lateral loads.

U.S. Pat. No. 4,184,600 to Goss et al. discloses a method for removing a bearing assembly disposed between a revolving turntable of a pedestal crane assembly and the pedestal. The bearing of the Goss et al. disclosure is removable. The kingpost described in the Goss et al. patent describes a typical kingpost upper end having a lateral surface engaged by a thrust bearing and a cylindrical structure having a side member engaged by radial bearings. The method includes activating a support member capable of co-acting with and between the revolving turntable of the pedestal crane assembly and the upper end of the pedestal, centering the revolving turntable about the support column with alignment means, removing a retainer plate capable of securing radial and thrust bearings in position, and thereafter withdrawing the bearings from the support column and revolving turntable to permit inspection and replacement thereof.

U.S. Pat. No. 5,328,040 to Morrow discloses a thrust-centering crane having an upper bearing assembly including discrete thrust and radial bearings.

A prior art crane constructed by Marathon LaTourneau includes an upper bearing assembly and a lower thrust bearing assembly. The upper bearing assembly comprises a sphere referred to as a pivot ball attached to an upper lateral surface of the pedestal support column. A closed-end, hollow cylinder pivot ball cap surrounds the pivot ball. Segments of bronze having an inner face shaped to conform to the ball cap and an outer face conforming to the interior of a closed-end, hollow cylinder surround the pivot ball. The upper crane assembly includes thrust and radial bearings. A disadvantage of the Marathon LaTourneau crane is stress concentration at the ball base interface with the lateral support surface, thereby limiting the load capacity of the crane. Other disadvantages include: (i) to change the upper bearing requires partial removal of the upper works; (ii) the upper bearing totally encases the spherical pin, which prohibits or substantially impairs visual inspection without removing the bearing, and (iii) the upper bearing design prevents through passage for services such as electric swivels and air swivels.

BRIEF SUMMARY OF THE INVENTION

Accordingly, it is an object of the present invention to provide a simplified upper bearing assembly for use with a crane comprising a reduced number of parts. It is a further object of the present invention to provide a simplified method for inspecting and/or replacing the bearing. It is yet a further object of the present invention to maintain the overall load capacity of the crane.

The present invention comprises an upper bearing assembly for a pedestal crane comprising a pedestal support column having a dome-shaped upper end operably engaged by a bearing having an inner face shaped to conform to a segment of said dome, the bearing enclosed within a rigid bearing cover, the bearing cover fixedly attached to the crane upper works, the dome, the bearing and the bearing cover, co-acting to provide both vertical and radial bearing surfaces of the crane upper works. The bearing is constructed of an engineered plastic, metal alloy, or other suitable bearing material. In a preferred embodiment, an opening is provided in the dome center for attachment of an electrical swivel, a hose swivel or other services. The bearing extends along said dome exterior intermediate said central opening and the dome side surface.

Other features and advantages of the invention will be apparent from the following description, the accompanying drawing and the appended claims.

DESCRIPTION OF THE INVENTION

Figure 2:
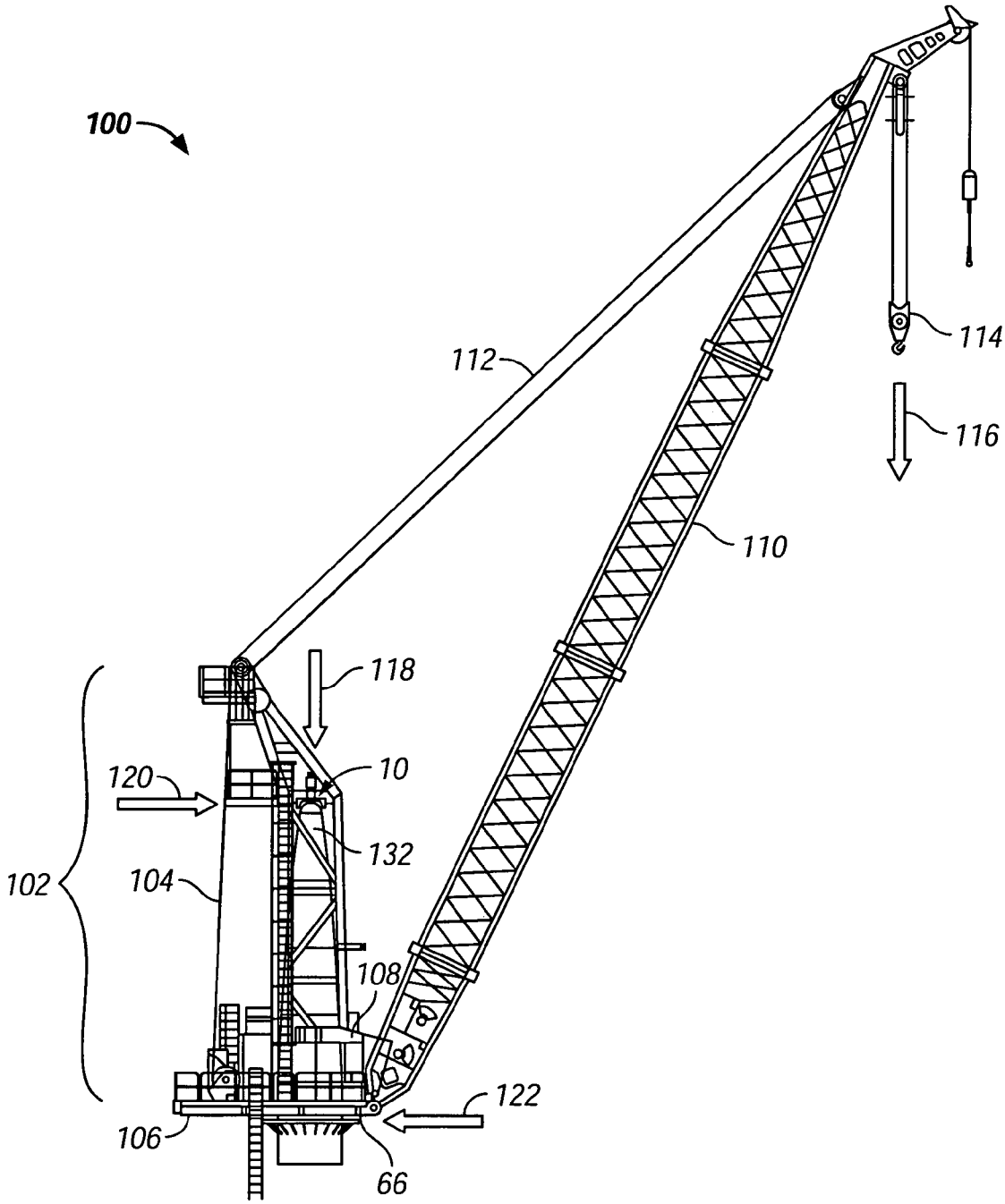
FIG. 2 is a side view of a pedestal crane including an upper bearing assembly of the present invention.

Referring first to FIG. 2, a pedestal crane 100 is depicted. Pedestal crane 100 includes an upper works 102, crane boom 110, and kingpost 132.

Upper works 102 includes crane gantry 104, turntable 106, and cab 108. Upper works 102 supports crane boom 110, hoist lines 112 and associated equipment. Crane boom 110 is pivotally connected to upper works 102 proximate turntable 106. Crane gantry 104 is structured to encompass kingpost 132.

In operation, upper works 102 is supported on kingpost 132 and rotates around kingpost 132. Kingpost 132 is attached to a supporting structure, such as a rig, water-borne vessel, or dock, or embedded in the ground. Accordingly, kingpost 132 is constructed of steel capable of bearing heavy stresses and strains without failure with appropriate welded connections, although other suitable high-strength materials may be used if desired.

Representational forces acting upon crane 100 during operation are depicted in FIG. 2. Such forces include load weight 116 at crane hook 114, crane weight 118, lateral force 120 due to overturning moment and lateral force 122 due to overturning moment.

Figure 1:
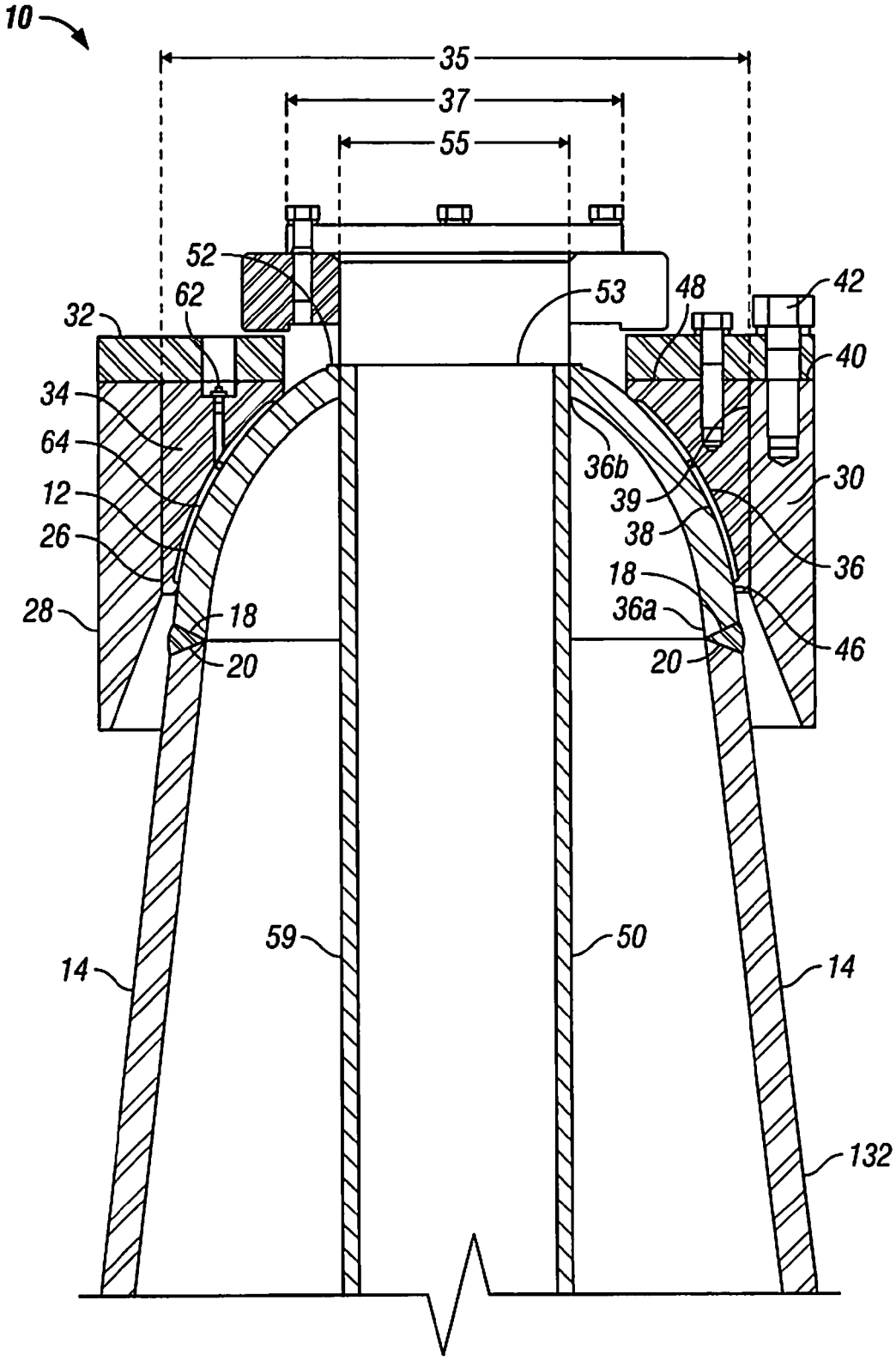
FIG. 1 is a cross-sectional view of an upper bearing assembly of the present invention.
Figure 4:
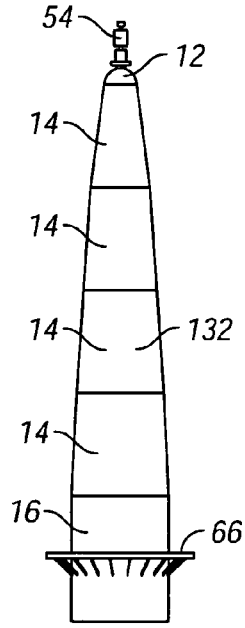
FIG. 4 is a side view of a pedestal support column.

Referring to the preferred embodiment depicted in FIGS. 1, 2 and 4, kingpost 132 is comprised of a plurality of segments, wherein lower kingpost segment 16 provides the base segment of kingpost 132, and kingpost hemispherical head 12 comprises the uppermost segment. In the preferred embodiment, at least one transition segment 14 is provided intermediate lower kingpost segment 16 and kingpost hemispherical head 12. Transition segments 14 comprise tapered, hollow cylinders to allow a determined reduction in diameter of kingpost 132 from lower kingpost segment 16 to kingpost hemispherical head 12. In the preferred embodiment, kingpost hemispherical head 12 is a dome-shaped structure having an opening 53 proximate the apex of the dome structure.

Kingpost hemispherical head 12 lower edge 18 abuts upper edge 20 of the upper transition segment 14 and is integrally connected. Kingpost hemispherical head 12 is arcuately formed, such that a cross-section of kingpost hemispherical head 12 displays a convex bearing surface 38. The structure of the kingpost 132, particularly the arcuate structure of upper kingpost hemispherical head 12 and the continuity of lower edge 18 with upper edge 20, limits stress risers at upper kingpost hemispherical head 12 during operation of pedestal crane 100.

Convex bearing surface 38 arcuately extends from lower edge 18 to opening 53 in kingpost hemispherical head 12, thereby forming at least a partial hemisphere.

Figure 3:
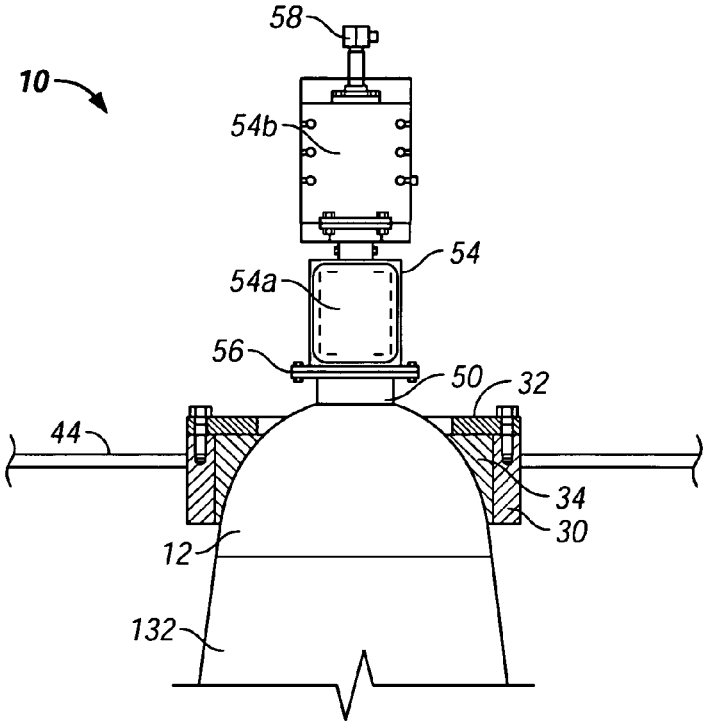
FIG. 3 is a cross-sectional detail of upper bearing assembly of the present invention.

Referring to FIGS. 1 and 3, a conduit 50 extends through opening 53. Conduit 50 extends generally vertically through kingpost 132, proximate the central axis of kingpost 132. Conduit 50 allows the passage of electrical cabling, communication cabling, air hose and/or hydraulic hose through the central axis of kingpost 132. Such central location is advantageous as appropriate swivel connectors may be installed to allow rotation of cables and hose during rotation of upper works 102.

Figure 5:
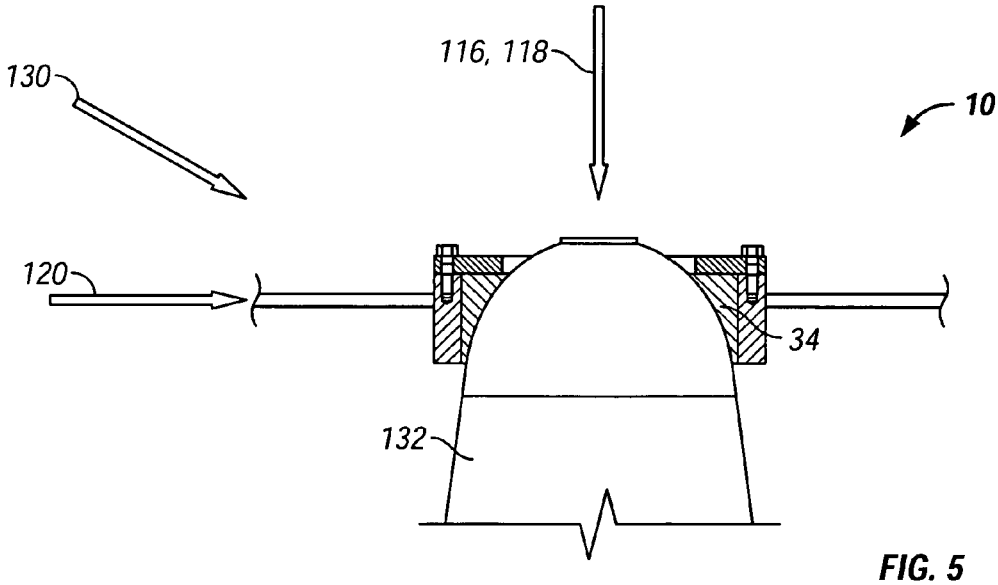
FIG. 5 is a side view of the upper bearing assembly of the present invention.

Referring to FIGS. 1, 3 and 5, upper bearing assembly 10 of the present invention is depicted. Upper bearing assembly 10 includes bearing retainer 30, retainer cap 32, and bearing 34. Bearing 34 comprises a cylinder having a concave bearing surface 36, which is slidingly engageable with convex bearing surface 38. Bearing 34 is configured to conform to and engage at least a portion of convex bearing surface 38 of kingpost hemispherical head 12. Bearing 34 extends from a lower side surface 36*a*of kingpost hemispherical head 12, proximate edge 18, to an upper surface 36*b* of upper kingpost hemispherical head 12, proximate opening 53. Bearing 34 is sized such that it at least partially encompasses kingpost hemispherical head 12.

Bearing 34 has an exterior bearing diameter 35, which uniformly extends across the width of bearing 34. Bearing 34 has an interior bearing diameter 37. Interior diameter 37 progressively increases from bearing upper end 48 to bearing lower end 46. At all points, interior bearing diameter 37 is larger than diameter 55 of opening 53, thereby permitting bearing upper end 48 to circumscribe opening 53. To facilitate uninhibited removal of bearing 34, the structure of bearing 34 is such that bearing lower end 46 is laterally thinner than the bearing upper end 48. As seen in FIG. 5, this structural configuration also provides a uniform bearing surface in the area incurring the resultant of the lateral force 120 and vertical forces 116, 118. While the preferred embodiment comprises a partial hemisphere bearing surface 38 of kingpost hemispherical head 12 and concave bearing surface 36, the invention may be practiced with concave and convex curved surfaces deviating from a sphere segment structure.

In the illustrative embodiment, bearing retainer 30 is a hollow cylinder defined by interior bearing retainer surface 26 and exterior bearing retainer surface 28. Bearing retainer 30 is sized such that interior bearing retainer surface 26 provides a surface for snugly retaining exterior bearing surface 39. Bearing retainer 30 defines a cap opening (not shown), which provides access to bearing 34. A retainer cap 32 is removeably attached to bearing retainer 30 at upper retainer edge 40. In a preferred embodiment, retainer cap 32 is attached to retainer 30 by a plurality of bolts 42. However, retainer cap 32 may be attached by similar attaching means known in the art. When retainer cap 32 is attached to bearing retainer 30, the cap opening is in a closed position, preventing access to bearing 34. When retainer cap 32 is removed from bearing retainer 30, the cap opening is in an open position, thereby allowing removal of bearing 34.

Figure 6:
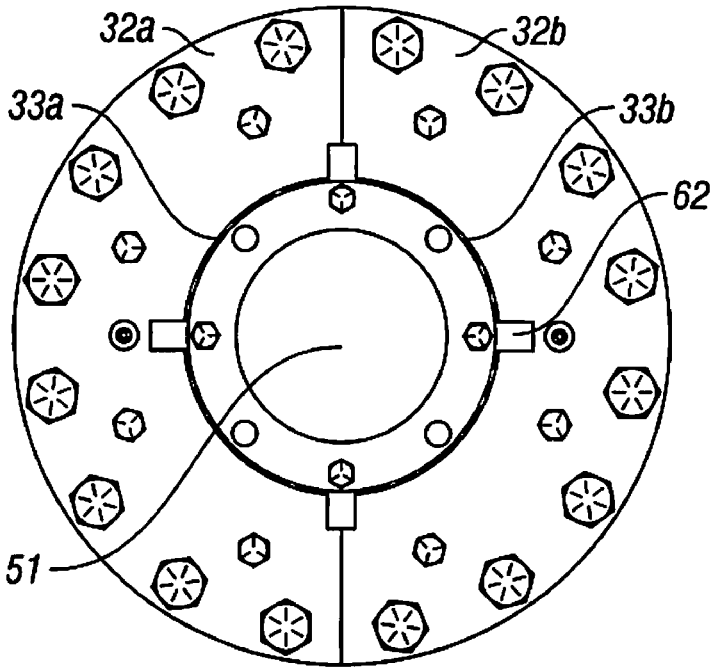
FIG. 6 is a top view of the bearing retainer and cap of the present invention.

In the preferred embodiment, retainer cap 32 comprises two semi-circular sections 32*a* and 32*b* as depicted in FIG. 6. Semi-circular sections 32*a* and 32*b* each cover substantially one-half of bearing retainer 30, wherein semi-circular section 32*a* covers bearing segment 34*a*, and semi-circular section 32*b* covers bearing segment 34*b*. Each semicircular section 32*a* and 32*b* has a semi-circular cap inset 33*a* and 33*b* respectively. Semicircular insets 33*a* and 33*b* define an opening 51 generally conforming with outer surface 59 of conduit 50. The semi-circular sections 32*a* and 32*b* are accordingly separately removable for replacement of bearing 34.

Figure 7:
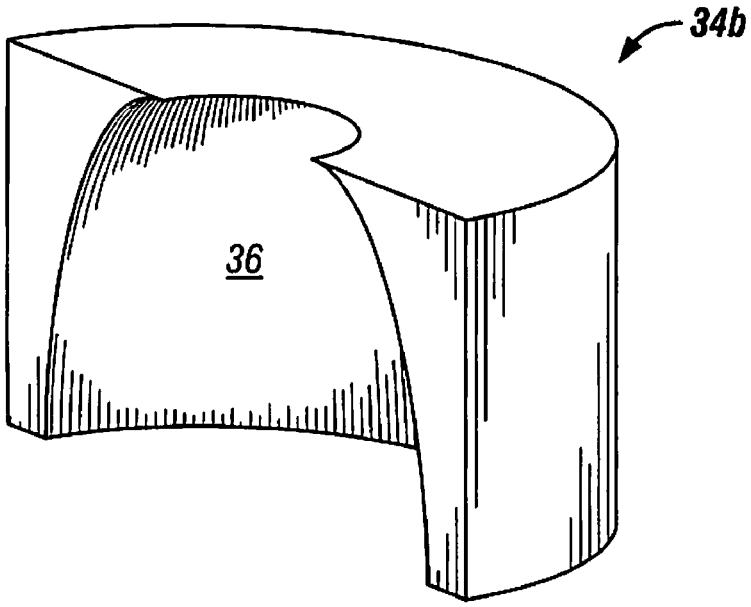
FIG. 7 is an isometric view of a bearing segment.

In the preferred embodiment, bearing 34 consists of two segments, bearing segment 34*a* (not shown) and bearing segment 34*b* (seen in FIG. 7), to facilitate removal and interchange with replacement segments without need to disconnect any cables or hoses extending through conduit 50. Bearing segment 34*a* and bearing segment 34*b* each extend around substantially one-half of the outer circumference of kingpost hemispherical head 12.

Referring to FIGS. 1 and 6, a grease fitting 62 is provided in each bearing segment 34*a* and 34*b*. Each grease fitting 62 is in fluid communication with at least one grease channel 64 on concave bearing surface 36. The grease fitting 62 and grease channels 64 allow for regular lubrication of the interface of concave bearing surface 36 with convex bearing surface 38.

A cross-structure member 44 is fixedly attached to bearing retainer 30 and to gantry 104. In operation, gantry 104, and thus upper works 102, revolves around kingpost 132. Bearing retainer 30 and retainer cap 32 revolve with gantry 104, while kingpost 132 is fixed. Bearing 34 rotates with bearing retainer 30 and retainer cap 32, with a sliding interface at surfaces 36 and 38.

Referring to FIGS. 1 and 3, an electrical swivel connector 54 is connected at channel upper end 56. Electrical swivel connector 54 is a commercially available connector that allows rotating connection of electrical and communication cables (not shown), such cables to the lower connector 54*a* and to the upper connector 54*b*. A hose swivel connector 58 is connected above swivel connector 54. Hose swivel connector 58 is a commercially available connector that allows rotating connection of a hydraulic hose with a line extending through conduit 50.

Referring again to FIG. 2, bearing assembly 10 incurs the combined thrust load of crane weight 118 and the load weight 116 and further incurs horizontal overturning moment 120. A lower bearing assembly (not shown) at kingpost lower column 16 incurs a horizontal overturning moment 122. Referring to FIG. 5, horizontal moment 120 and thrust forces 118 and 116 produce a combined resultant force 130 on bearing 34. The configuration of bearing 34 allows bearing 34 to singularly exert vertical and horizontal forces on upper kingpost hemispherical head 12 from upper works 102 and from any load weight 116.

The preferred material of bearing 34 is a nylon 6 with molybdenum disulfide impregnation. However, similar materials known in the art may be used, provided the materials are sufficiently strong to bear the weights associated with total crane and load weight, but softer than the steel of upper kingpost hemispherical head 12 and bearing retainer 30 and retainer cap 32. Accordingly, bearing 34 wears before the steel that it interfaces.

As the bearing 34 is designed to wear prior to and in lieu of the steel interface materials, it is necessary to replace bearing 34 from time to time. The bearing assembly 10 of the present invention provides an improvement over the prior art in that bearing 34 is readily replaceable using conventional equipment. To replace bearing 34, a plurality of commercially-available jacks or spacers may be used to support upper works 102 on kingpost 32. A preferred method is to provide spacers (not shown) intermediate turntable 106 and slew gear 66. With the upper works 102 supported on slew gear 66, a retainer cap 32*a* or 32*b* may be removed. As previously stated, the structure of bearing 34 is such that bearing 34 lower end 46 is laterally thinner than the bearing 34 upper end 48. Accordingly a bearing segment 34*a* or 34*b* corresponding to the retainer cap segment 32*a* or 32*b* previously removed may be lifted out of bearing retainer 30. A replacement bearing segment 34*a* or 34*b* may then be inserted and the retainer cap segment 32*a* or 32*b* may be replaced. The next bearing segment 34*a* or 34*b* is then replaced in like manner. After replacement of bearing segments 34*a* and 34*b*, the spacers may be removed so that the upper works 102 is again supported at bearing 34.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

The invention claimed is:

1. A bearing assembly for a crane, said crane having a kingpost and an upper works, said bearing assembly comprising:

said kingpost having a hollow kingpost head attached integrally to the kingpost;

a hollow conduit extending upwardly through said kingpost head;

said head having a convex bearing surface;

a bearing having a concave bearing wear surface;

said upper works at least partially supported by said bearing;

said bearing retained in a rigid bearing retainer;

said bearing retainer connected to said upper works;

said bearing retainer having a retainer can;

said retainer can selectively removable;

said kingpost head having an outer head circumference;

said bearing comprising a first bearing segment and a second bearing segment;

said first bearing segment extending around substantially one-half of said outer head circumference: and said second bearing segment extending around substantially one-half of said outer head circumference.

2. The bearing assembly of claim 1, further comprising:

said retainer cap comprising a first cap segment and a second cap segment;

said first cap segment covering substantially one-half of said bearing retainer;

said second cap segment covering substantially one-half of said bearing retainer; and each of said first cap segment and said second cap segment separately removable from said bearing retainer.

3. The bearing assembly of claim 2, further comprising:

said first cap segment covering said first bearing segment;

said second cap segment covering said second bearing segment;

said first bearing segment removable upon removal of said first cap segment; and said second bearing segment removable upon removal of said second cap segment.

4. A bearing assembly for a crane, said crane having a kingpost and an upper works, said bearing assembly comprising:

said kingpost having a hollow kingpost head attached integrally to the kingpost;

said kingpost head having a dome-shaped head segment;

said dome-shaped head segment having an exterior bearing surface;

a bearing having an inner bearing wear surface;

said inner bearing surface constructed to conform to at least a portion of said head exterior bearing surface;

said upper works at least partially supported by said bearing;

said kingpost head having a head opening proximate an apex of said head;

an opening in said bearing corresponding to said head opening;

a conduit extending through said head opening and said bearing opening, said kingpost head having an outer head circumference;

said bearing comprising a first bearing segment and a second bearing segment;

said first bearing segment extending around substantially one-half of said outer head circumference;

said second bearing segment extending around substantially one-half of said outer head circumference; and said bearing retained in a rigid bearing retainer.

5. The bearing assembly of claim 4, further comprising:

said bearing retainer having a retainer cap;

said retainer cap comprising a first cap segment and a second cap segment;

said first cap segment covering substantially one-half of said bearing retainer;

said second cap segment covering substantially one-half of said bearing retainer; and each of said first cap segment and said second cap segment separately removable from said bearing retainer.

6. The bearing assembly of claim 5, further comprising:

said first cap segment covering said first bearing segment;

said second cap segment covering said second bearing segment;

said first bearing segment removable upon removal of said first cap segment; and said second bearing segment removable upon removal of said second cap segment.

7. A crane bearing assembly for a crane, said crane having a support column and an upper works, comprising:

said support column having a hollow column head attached integrally to the support column;

said column head having a head convex surface;

a bearing having a bearing concave wear surface; said bearing concave surface slidingly engageable with said head convex surface; a hollow conduit distinct from said hollow column head extending upwardly from said support column;

said head convex surface and said bearing concave surface surrounding said hollow conduit;

said bearing functionally intermediate said upper works and said column head;

a rigid bearing retainer connected to said upper works; and said bearing retained in said bearing retainer.

8. The crane bearing assembly of claim 7, said crane bearing assembly further comprising:

said bearing comprising at least two bearing segments; and said at least two bearing segments separately removable from said bearing retainer.

* * * * *